US005499800A

United States Patent [19]

Albin

[11] Patent Number: 5,499,800

[45] Date of Patent: Mar. 19, 1996

[54] ADJUSTABLE TOGGLE ACTION QUICK RELEASE LOCKING BAR CLAMP

[76] Inventor: Stephen D. Albin, 610 Rancho, Los Altos, Calif. 94024

[21] Appl. No.: 289,931

[22] Filed: Aug. 12, 1994

[51] Int. Cl.[6] ..... B25B 1/24

[52] U.S. Cl. ..... 269/6; 269/204; 269/147; 269/228; 81/375; 81/378; 81/487

[58] Field of Search ..... 269/3, 6, 228, 269/203–206, 147–149, 166; 81/487, 373–378, 367–372, 129

[56] References Cited

U.S. PATENT DOCUMENTS

| | | | |
|---|---|---|---|
| 1,187,109 | 6/1916 | Stevernagel | 269/204 |
| 2,312,947 | 3/1943 | Westman | 81/378 |
| 2,533,817 | 12/1950 | Koskinen | 81/375 |
| 2,561,682 | 7/1951 | Barnett | 81/375 |
| 3,210,070 | 10/1965 | Lagana | 81/373 |
| 4,339,113 | 7/1982 | Vosper | 269/204 |
| 4,850,254 | 7/1989 | Burney | 269/228 |
| 5,050,466 | 9/1991 | Cameron | 81/487 |
| 5,096,170 | 3/1992 | Albin | 269/6 |

FOREIGN PATENT DOCUMENTS

| | | | |
|---|---|---|---|
| 620679 | 7/1962 | Belgium | 269/204 |
| 3152016 | 7/1983 | Germany | 269/166 |

*Primary Examiner*—Robert C. Watson
*Attorney, Agent, or Firm*—Hickman & Beyer

[57] ABSTRACT

A bar clamp having a locking pliers, toggle action clamping mechanism is herein disclosed. The locking pliers includes a fixed handle, a movable handle, and a toggling linkage arrangement therebetween for toggling the locking pliers from a first open position to a second clamped position. An extension bar is connected at one end to the fixed handle. The bar clamp includes an adjustable outer clamping jaw slidably connected to the extension bar. The outer clamping jaw includes disengagable locking mechanism for disengagably locking the outer clamping jaw in any given position along the length of the extension bar. The bar clamp also includes an inner clamping jaw connected to the toggling linkage arrangement such that when the locking pliers are toggled into the clamped position the inner clamping jaw is caused to move toward the adjustable outer clamping jaw.

24 Claims, 2 Drawing Sheets

ADJUSTABLE TOGGLE ACTION QUICK RELEASE LOCKING BAR CLAMP

BACKGROUND OF THE INVENTION

The present invention relates generally to toggle action hand tools, and more specifically to an adjustable length locking bar clamp with a locking pliers type, toggle action clamping mechanism.

Locking pliers type hand tools with toggle action clamping mechanisms are generally known as locking pliers or vice clamps. These conventional tools usually include a fixed handle having a fixed jaw extending from one end of the fixed handle, a movable handle, and a toggling linkage arrangement interconnecting the fixed handle and the movable handle. The toggling arrangement typically includes a movable jaw extending from the toggling linkage arrangement in such a way that when the locking pliers are toggled from a first open position to a second toggled position the movable jaw is moved toward the fixed jaw.

Since the original development of the locking pliers a wide variety of jaw arrangements have been developed for all types of applications. For example, U.S. Pat. No. 4,850,254 describes a locking hand tool including locking pliers in which a user adjustable jaw and a movable jaw are moved toward one another in a direction generally perpendicular to the handles of the locking pliers when the locking pliers are toggled into the locked or toggled position. This arrangement provides an adjustable clamp in which the locking pliers extend perpendicular to the direction of clamping action. Although this a useful arrangement in some situations, there are many situations in which the generally perpendicular location of the locking pliers interferes with the work being performed. The present invention discloses a toggle action quick release bar clamp having a specific jaw arrangement for toggle action locking pliers which provides a bar clamp with a clamping action direction that is along the longitudinal axis of the locking pliers handle or parallel with the handle.

SUMMARY OF THE INVENTION

As will be described in more detail hereinafter, a locking bar clamp having a locking pliers, toggle action clamping mechanism is disclosed. The locking pliers includes a fixed handle, a movable handle, and toggling linkage mechanism extending therebetween for toggling the locking pliers from a first open position to a second clamped position. An extension bar is connected to the fixed handle. An adjustable outer clamping jaw is slidably connected to the extension bar. The outer clamping jaw includes disengagable locking mechanism for disengagably locking the outer clamping jaw at any given position along the length of the extension bar. The bar clamp also includes an inner clamping jaw connected to the toggling linkage mechanism such that when the locking pliers are toggled into the clamped position the inner clamping jaw is caused to move toward the adjustable outer clamping jaw.

BRIEF DESCRIPTION OF THE DRAWINGS

The features of the present invention may best be understood by reference to the following description of the presently preferred embodiments together with the accompanying drawings in which.

DETAILED DESCRIPTION OF THE PREFERRED EMBODIMENTS

Figure 1A:
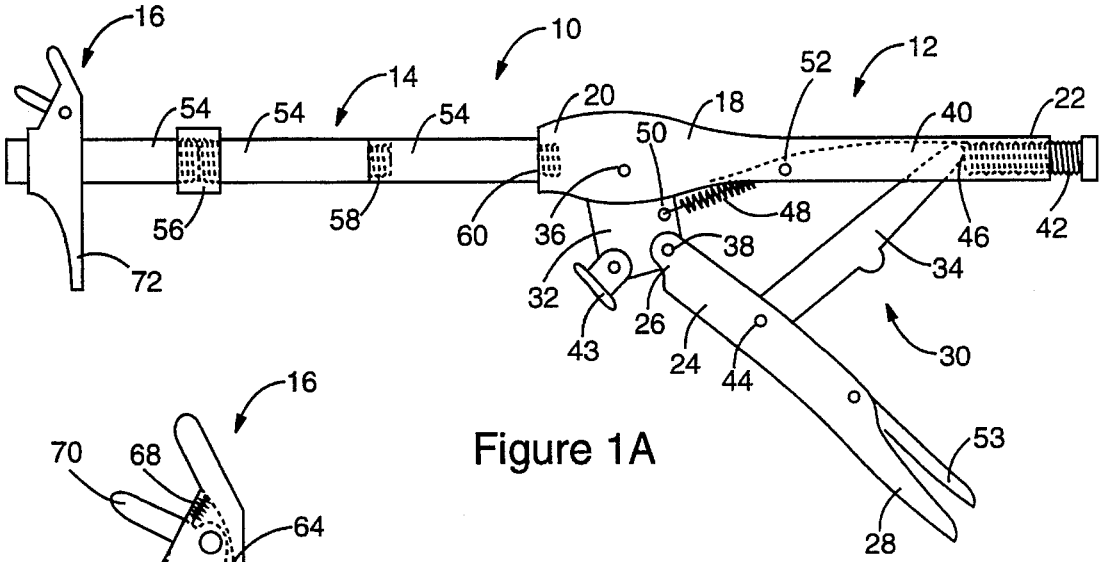
FIG. 1A is a diagrammatic side view of a first embodiment of an adjustable toggle action quick release bar clamp designed in accordance with the present invention.

Referring initially to FIG. 1A, a first preferred embodiment of an adjustable toggle action quick release bar clamp designed in accordance with the present invention and generally designated by reference numeral 10 is illustrated. As will be described in more detail hereinafter, bar clamp 10 includes a conventional locking pliers toggle action clamping mechanism generally designated by reference numeral 12, an extension bar arrangement extending from locking pliers 12 generally designated by reference numeral 14, and a slidable outer jaw arrangement generally designated by reference numeral 16.

Still referring to FIG. 1A the conventional locking pliers 12 will now be described in detail. Locking pliers of this type typically include a fixed handle 18 having a first end 20 and a second end 22, a movable handle 24 also having a first end 26 and a second end 28, and a toggling linkage arrangement generally designated by reference numeral 30 interconnecting fixed handle 18 and movable handle 24. In the particular locking pliers illustrated, the toggling linkage arrangement includes a first toggling lever 32 and a second toggling lever 34. The first toggling lever 32 is pivotally connected at point 36 to the first end 20 of fixed handle 18 and pivotally connected at point 38 to the first end 26 of movable handle 24. Fixed handle 18 is formed having a channel 40 along its length and an adjusting screw 42 threaded into its second end 22. The second toggling lever 34 has a first end pivotally connected at point 44 near the mid point of movable handle 24 and its other end indicated at point 46 is positioned within channel 40 of fixed handle 18 against the end of adjusting screw 42. Toggling linkage arrangement 30 also includes a spring 48 attached at one end to a mid point 50 of toggling lever 32 and attached at its other end to a mid point 52 of fixed handle 18. This toggling linkage arrangement allows the locking pliers to be toggled between a first open position and a second locked or clamped position.

When locking pliers 12 are moved from the open position to the clamped position, movable handle 24 drives against toggling lever 32 at pivot point 38. Movable handle 24 is forced against toggling lever 32 by toggling lever 34 at pivot point 44. And finally toggling lever 34 is forced against movable handle 24 by the end of adjusting screw 42 at point 46. Therefore, movable handle 24 forces toggling lever 32 to pivot about point 36 on fixed handle 18 such that toggling lever 32 moves generally along the longitudinal axis of fixed handle 18 in the direction away from adjusting screw 42. In a presently preferred embodiment of the present invention, an inner clamping jaw 43 is pivotally connected to toggling lever 32. It should be appreciated that, the toggling lever 32 may also be formed as an integrated part of the clamping jaw. Therefore, as the locking pliers are moved from the open position to the clamped position, inner clamping jaw 43 is also moved generally along the longitudinal axis of fixed handle 18 in the direction away from adjusting screw 42. Furthermore, adjusting screw 42 gives the user of the tool an infinitesimal control over the relative position of the inner clamping jaw 43 relative to fixed handle 18 along the longitudinal axis of the tool within a certain range.

When in the open position and when viewed as shown in FIG. 1A, point 44 on movable handle 24 is out of line with and below the line formed by point 38 on movable handle 24 and point 46 at the end of adjusting screw 42. However, when the locking pliers are moved into the clamped position, point 44 on movable handle 24 is rotated about point 38 on movable handle 24 between points 38 and 46 to a position above the line formed by points 38 and 46. This moving of point 44 from below the line between points 38 and 46 causes the toggling or locking action of the locking pliers. The specific locking pliers shown in FIG. 1A also includes a quick release lever 53 which, when the locking pliers are in the clamped position, engages toggling lever 34. This quick release lever allows the user to quickly move the locking pliers from the clamped position to the open position by forcing movable handle downward as viewed in FIG. 1A such that point 44 is rotated around point 38 to a position below the line between points 38 and 46.

Although FIG. 1A and FIGS. 2–5 each show a locking pliers as described immediately above, it should be understood that the present invention is not limited to using this specific locking pliers arrangement but instead would apply to any conventional toggle action locking pliers clamping mechanism regardless of its specific toggling arrangement.

Still referring to FIG. 1A, extension bar arrangement 14 will now be described in detail. In a presently preferred embodiment of the present invention, extension bar arrangement 14 includes a plurality of circular cross section extension bar sections 54 having their ends threaded for interconnecting the sections. The extension bar sections may be joined with an internally threaded coupling tube 56 or alternatively, one end of each extension bar section 54 may be internally threaded and the other end externally threaded such that each externally threaded end of a given section may be attached to the internally threaded end of the adjacent section as illustrated at point 58 on extension bar arrangement 14.

In the presently preferred embodiment, overall extension bar arrangement 14 is connected to the fixed handle 18 of the locking pliers 12 using the same threaded ends as described above for the extension bar sections. End 20 of fixed handle 18 of the locking pliers includes an internally threaded opening 60 for receiving the externally threaded end of one of the extension bar sections 54. By using the same threaded ends as is used for interconnecting the extension bar sections, each of the sections are interchangeable and modular such that the length of the overall extension bar may be easily increased by adding sections to achieve the desired bar clamp length.

Also, in accordance with the present invention, extension bar arrangement 14 is attached to locking pliers 12 such that the longitudinal axis of the extension bar arrangement is substantially in line with or at least substantially parallel with the longitudinal axis of the fixed handle 18 of locking pliers 12. This specific orientation of the extension bar arrangement 14 positions the slidable outer clamping jaw arrangement 16 in the proper position such that when the locking pliers are moved from the open position to the clamped position, as described in detail above, inner clamping jaw 43 is forced along the longitudinal axis of the tool toward outer clamping jaw arrangement 16 providing an adjustable clamping arrangement. Furthermore, since the extension bar 14 is attached to the fixed handle 18 of the locking pliers, adjusting screw 42 gives the user of the tool an infinitesimal control over the relative position of the inner clamping jaw 43 relative to the slidable outer clamping jaw 16 along the longitudinal axis of the tool within a certain range for any given positioning of the outer jaw.

Although the extension bar arrangement has been described as having a circular cross section, it should be understood that the present invention is not limited to an extension bar with a circular cross section, but instead would apply to an extension bar of any cross section such as square, rectangular, oval. or I-beam shaped. Also, even though the extension bar has been described as being detachable, and including a plurality of sections, these features are not required to be included in the present invention. For instance, extension bar arrangement 14 may be permanently fixed to the locking pliers with or without removable sections or may be detachably attached to the locking pliers by an arrangement other than the threaded arrangement described. It should be understood that the present invention would equally apply to these other arrangements.

Figure 1B:
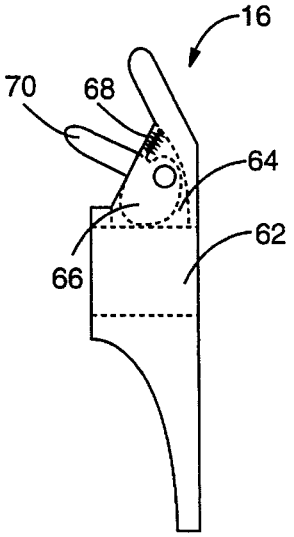
FIG. 1B is a diagrammatic side view of the outer clamping jaw shown in FIG. 1A.

Referring now to FIG. 1B, the outer clamping jaw arrangement 16 will be described in detail. In a preferred embodiment of the present invention, outer clamping jaw arrangement 16 includes a portion having a circular cross sectional opening 62 through which the arrangement is slidably connected to extension bar 14. Outer clamping jaw arrangement 16 also includes a portion having a slot 64 for receiving a locking cam 66 pivotal mounted to jaw arrangement 16 such that locking cam 66 may engage extension bar 14 when jaw arrangement 16 is slidably attached to the bar. A spring 68 biases locking cam 66 to engage extension bar 14 and locking cam 66 is positioned such that when pressure is exerted on jaw arrangement 16 in the direction away from the locking pliers, locking cam 66 prevents jaw arrangement 16 from sliding along extension bar 14. However, this arrangement allows the user to slide jaw arrangement 16 toward the locking pliers without disengaging cam 66. Locking cam 66 also includes a lever 70 extending :from locking cam 66 designed to allow the user of the tool to disengage locking cam 66 allowing the outer clamping jaw arrangement 16 to slide freely along extension bar 14. Jaw arrangement 16 also includes an outer clamping pad 72 extending form the side of jaw arrangement 16 opposite locking cam 66.

With the immediately above described arrangement for outer clamping jaw arrangement 16, this arrangement may be rotated about the longitudinal axis of extension bar 14. This allows the user of the tool to position outer clamping pad 72 out of line with inner clamping jaw 43. This may be particularly important in situations where an irregular shaped piece is being clamped and there is not an adequate surface for outer clamping pad 72 to bear on when the inner and outer jaws are in line with one another.

Although only one specific arrangement for outer clamping jaw arrangement has been described, it should be understood that this arrangement may take many forms. For instance, if the cross sectional shape of extension bar 14 is something other than circular, opening 62 may be made to match the other cross sectional shape. Also, it should be understood that other locking mechanisms may be used such as set screws, locking levers, or any other conventional arrangement for locking a movable jaw in place.

Figure 2:
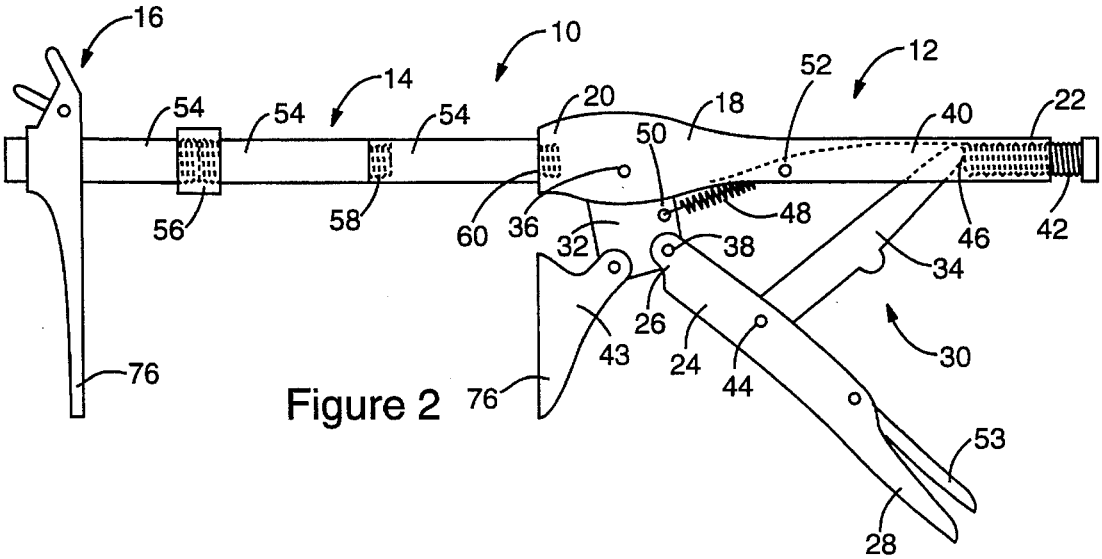
FIG. 2 is a diagrammatic side view of a second embodiment of an adjustable toggle action quick release bar clamp designed in accordance with the present invention.
Figure 3:
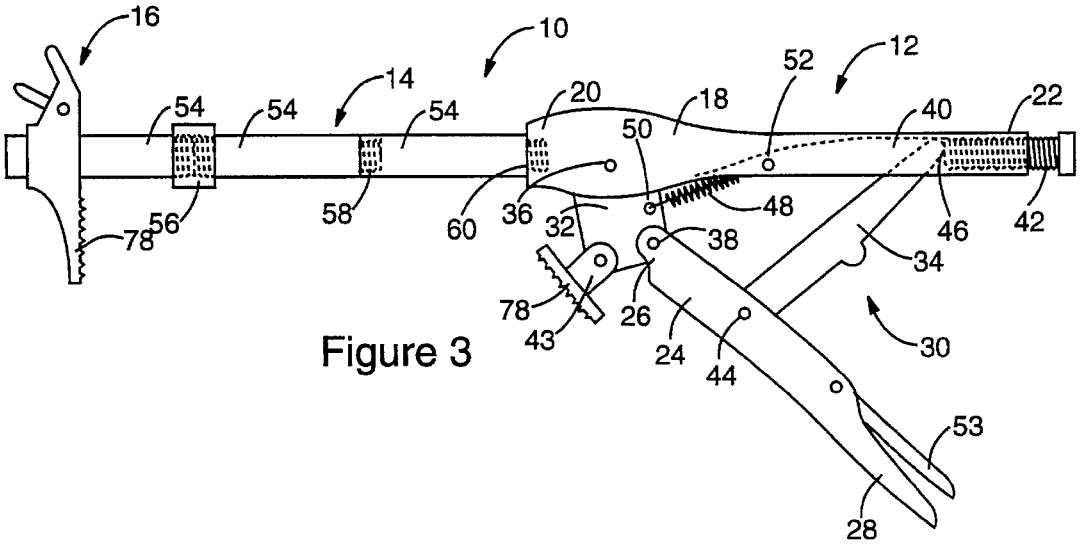
FIG. 3 is a diagrammatic side view of a third embodiment of an adjustable toggle action quick release bar clamp designed in accordance with the present invention.
Figure 4:
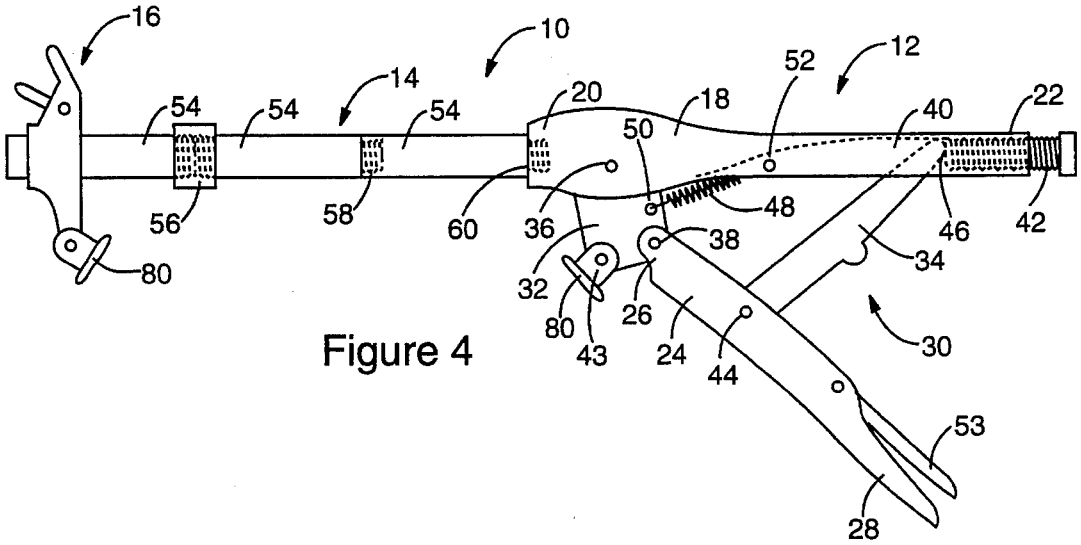
FIG. 4 is a diagrammatic side view of a fourth embodiment of an adjustable toggle action quick release bar clamp designed in accordance with the present invention.
Figure 5:
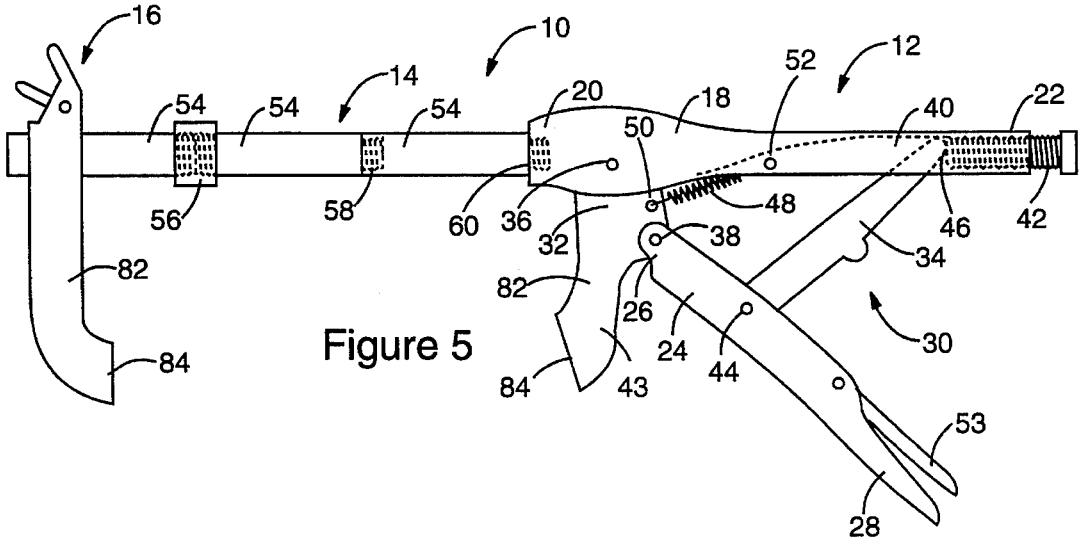
FIG. 5 is a diagrammatic side view of a fifth embodiment of an adjustable toggle action quick release bar clamp designed in accordance with the present invention.

Referring now to FIGS. 2–5, as shown in these figures, inner clamping jaw 43 and outer clamping jaw 16 may include clamping tips having a wide variety of shapes. FIG. 2 illustrates a toggle action bar clamp in which the clamping jaws each have an elongated flat surfaced tip 76. FIG. 3 illustrates a clamp designed in accordance with the present invention in which each of the clamping jaws includes a serrated tip 78. In FIG. 4, a pair of swivel type tips 80 are connected to the clamping jaws. And finally in FIG. 5, inner and outer clamping jaws 43 and 16 each include a curved arm 82 having a clamping pad 84 at the end of the curved arm designed such that when the clamping pads 84 engage a work piece, curved arms 82 provide clearance to prevent the arms from engaging the work piece at points other than the clamping pads 84.

Although only a few embodiments of the present invention have been described in detail, it should be understood that the present invention may be embodied in many other specific forms without departing from the spirit or scope of the invention. As mentioned above, the extension bar may take on a wide variety of cross sectional shapes. It may be fixed to or detachable from the locking pliers and may be made up of a plurality of sections or one continuous bar. Also as mentioned above, the slidable outer jaw may take on a wide variety of specific shapes and incorporate a variety of locking arrangements for locking the outer jaw in place on the extension bar.

Therefore, the present examples are to be considered as illustrative and not restrictive, and the invention is not to be limited to the details given herein, but may be modified within the scope of the appended claims.

What is claimed is:

1. A locking bar clamp comprising:

a) a locking pliers mechanism including a fixed handle having a longitudinal axis, a movable handle, and a toggling linkage mechanism coupled between the fixed and moveable handles for toggling the locking pliers from a first open position to a second clamped position;

b) an elongated extension bar having a longitudinal axis and including first and second ends, the first end being connected to and extending from the fixed handle of the locking pliers such that the longitudinal axis of the extension bar is substantially parallel with the longitudinal axis of the fixed handle of the locking pliers;

c) an adjustable outer clamping jaw slidably connected to the extension bar for longitudinal movement along the extension bar, the outer clamping jaw including a disengagable locking mechanism for disengagably locking the outer clamping jaw to the extension bar; and d) an inner clamping jaw connected to the toggling mechanism such that when the locking pliers are toggled into the clamped position the inner clamping jaw is caused to move in a direction generally aligned with the longitudinal axis of the fixed handle of the locking pliers and the longitudinal axis of the extension bar toward the adjustable outer clamping jaw.

2. A locking bar clamp as set forth in claim 1 wherein the locking pliers mechanism includes adjusting means for adjusting the longitudinal position of the inner clamping jaw relative to the fixed handle of the locking pliers.

3. A locking bar clamp as set forth in claim 2 wherein:

the toggle linkage mechanism includes first and second linkages coupled between the fixed and moveable handles;

the fixed handle includes a channel; and the adjusting means includes an adjusting screw threaded into the fixed handle for adjusting the position of a first end of the first linkage relative to the fixed handle, thereby adjusting the longitudinal position of the inner clamping jaw.

4. A locking bar clamp as set forth in claim 1 wherein the toggling linkage mechanism includes first and second linkages coupled between the fixed and moveable handles and a quick release lever and wherein the inner clamping jaw is pivotaly connected to the second linkage.

5. A locking bar clamp as set forth in claim 1 wherein the extension bar is detachable from the fixed handle.

6. A locking bar clamp as set forth in claim 1 wherein the extension bar has a circular cross section.

7. A locking bar clamp as set forth in claim 6 wherein the extension bar includes a plurality of detachable extension bar sections allowing for a variety of extension bar lengths.

8. A locking bar clamp as set forth in claim 7 wherein the detachable extension bar sections include threaded ends for interconnecting the extension bar sections.

9. A locking bar clamp as set forth in claim 6 wherein the adjustable outer clamping jaw includes an portion having a circular cross sectional opening through which the outer clamping jaw is slidably connected to the extension bar.

10. A locking bar clamp as set forth in claim 9 wherein the adjustable outer clamping jaw may be rotated to various positions around the longitudinal axis of the extension bar allowing the outer clamping jaw to be positioned out of line with the inner clamping jaw.

11. A locking bar clamp as set forth in claim 1 wherein the disengagable locking mechanism for locking the outer clamping jaw in position includes (i) a locking cam pivotally connected to the outer clamping jaw such that the locking cam may engage the extension bar, (ii) a spring for biasing the locking cam against the extension bar, and (iii) a lever extending from the locking cam adapted to allow the user of the tool to disengage the locking cam thereby allowing the outer clamping jaw to slide freely along the extension bar.

12. A locking bar clamp as set forth in claim 1 wherein the inner clamping jaw is pivotally connected to the toggling linkage mechanism of the locking pliers.

13. A locking bar clamp as set forth in claim 1 wherein the inner and outer clamping jaws each include an elongated flat clamping pad.

14. A locking bar clamp as set forth in claim 1 wherein the inner and outer clamping jaws each include a serrated clamping pad.

15. A locking bar clamp as set forth in claim 1 wherein the inner and outer clamping jaws each include a swivel type clamping pad pivotally connected to the respective inner and outer clamping jaws.

16. A locking bar clamp as set forth in claim 1 wherein the inner and outer clamping jaws each include an elongated curved clamping arm having a clamping pad adapted to engage the material to be clamped while providing clearance between the material and the elongated curved clamping arms.

17. A locking bar clamp as set forth in claim 1 wherein the longitudinal axis of the extension bar is substantially parallel with the longitudinal axis of the fixed handle of the locking pliers.

18. A locking bar clamp as set forth in claim 1 wherein the adjustable outer clamping jaw may be locked to the extension bar at any position along the length of the extension bar.

19. A bar clamp attachment for use with a locking pliers that includes a fixed handle having a longitudinal axis, a movable handle, a toggling linkage mechanism coupled between the fixed and moveable handles for toggling the locking pliers between a first open position and a second clamped position, and an inner clamping jaw connected to the toggling linkage mechanism of the locking pliers such that when the locking pliers are toggled between the open position and the clamped position the inner clamping jaw is caused to move in a direction generally aligned with the longitudinal axis of the fixed handle of the locking pliers, the bar clamp attachment comprising:

a) an elongated extension bar having a longitudinal axis and including a first end and a second end, the first end being adapted to be detachably connected to the fixed handle of the locking pliers such that the longitudinal axis of the extension bar is substantially parallel with the longitudinal axis of the fixed handle of the locking pliers; and b) an adjustable outer clamping jaw slidably connected to the extension bar for longitudinal movement along the extension bar, the outer clamping jaw including a disengagable locking mechanism for disengagably locking the outer clamping jaw to the extension bar.

20. A bar clamp as set forth in claim 19 wherein the extension bar has a circular cross section and the adjustable outer clamping jaw includes a portion having a circular cross sectional opening through which the outer clamping jaw is slidably connected to the extension bar.

21. A bar clamp as set forth in claim 19 wherein the extension bar includes a plurality of detachable extension bar sections allowing for a variety of extension bar lengths and the detachable extension bar sections include threaded ends for interconnecting the extension bar sections.

22. A bar clamp as set forth in claim 20 wherein the adjustable outer clamping jaw may be rotated to various positions around the longitudinal axis of the extension bar allowing the outer clamping jaw to be positioned out of line with the inner clamping jaw.

23. A bar clamp as set forth in claim 19 wherein the disengagable locking means for locking the outer clamping jaw in position includes (i) a locking cam pivotally connected to the outer clamping jaw such that the locking cam may engage the extension bar, (ii) spring means for biasing the locking cam against the extension bar, and (iii) a lever extending from the locking cam adapted to allow the user of the tool to disengage the locking cam thereby allowing the outer clamping jaw to slide freely along the extension bar.

24. A locking bar clamp comprising:

a) a locking pliers mechanism including a fixed handle having a longitudinal axis, a movable handle, and a toggling linkage mechanism coupled between the fixed and moveable handles for toggling the locking pliers from a first open position to a second clamped position;

b) an elongated extension bar having a substantially circular cross section and a longitudinal axis and including first and second ends, the first end being detachable and connectable to the fixed handle of the locking pliers such that the extension bar extends from the fixed handle of the locking pliers with the longitudinal axis of the extension bar substantially parallel to the longitudinal axis of the fixed handle of the locking pliers;

c) an adjustable outer clamping jaw slidably connected to the extension bar for longitudinal movement along the extension bar, the outer clamping jaw including (i) an portion having a circular cross sectional opening through which the outer clamping jaw is slidably connected to the extension bar (ii) a locking cam pivotally connected to the outer clamping jaw such that the locking cam may engage the extension bar, (iii) a spring arrangement for biasing the locking cam against the extension bar, and (iv) a lever extending from the locking cam adapted to allow the user of the tool to disengage the locking cam thereby allowing the outer clamping jaw to slide freely along the extension bar; and d) an inner clamping jaw connected between the fixed and moveable handles such that when the locking pliers are toggled into the clamped position the inner clamping jaw is caused to move in a direction generally aligned with the longitudinal axis of the fixed handle of the locking pliers and the longitudinal axis of the extension bar toward the adjustable outer clamping jaw.

* * * * *